US006075191A

United States Patent [19]

Scire

[11] Patent Number: 6,075,191

[45] Date of Patent: Jun. 13, 2000

[54] POWER FOOT PEDAL FOR DRUM SET

[76] Inventor: Jack Henry Scire, 4303 Hunters Glen Dr., Plainsboro, N.J. 08536

[21] Appl. No.: 09/059,437

[22] Filed: Apr. 14, 1998

[51] Int. Cl.[7] ..... G10D 13/02

[52] U.S. Cl. ..... 84/422.1

[58] Field of Search ..... 84/422.1, 422.2, 84/422.3

[56] References Cited

U.S. PATENT DOCUMENTS 3,967,523 7/1976 Currier et al. ..... 84/422.1
5,458,038 10/1995 Kurosaki .

*Primary Examiner*—Robert E. Nappi
*Assistant Examiner*—Shih-yung Hsieh

[57] ABSTRACT

An improved bass drum pedal that is power assisted for the playing performance on the bass drum of a drum set. The fundamental construction mounts a motor driven wheel (1) to a prior art, manual bass drum foot pedal (12). In response to operation of the foot pedal (12) by the player, player effort is assisted with action generated from the motor driven wheel (1). Wheel (1) acts as a lever action mechanism and rotating coupling from motor (6) to pedal (12). When played a differential lever action force to affect and assist the player's effort is generated across the diameter of wheel (1). Wheel (1) is driven with belt (8) along the base tangent point of wheel (1). At the opposite diameter of the wheel (1) is a drag or friction belt (9). Belt (9) is along the crest tangent point of the wheel (1). A differential force between belt 8 and belt 9 is created across wheel (1) diameter when the pedal is played. Interaction of the two forces create lever action effect across wheel (1) diameter to effect and assist the player's effort to play the pedal, providing smooth continuous power assisted action to the player's performance on the drums.

2 Claims, 2 Drawing Sheets

POWER FOOT PEDAL FOR DRUM SET

CROSS-REFERENCES TO RELATED APPLICATIONS

U.S. Pat. No. 3,967,523 July/1976 CURRIER, CANAVAN.

U.S. Pat. No. 5,458,038 October/1995 KUROSAKI.

STATEMENT REGARDING FEDERALLY SPONSORED RESEARCH OR DEVELOPMENT

"NOT APPLICABLE"

Reference to "Microfiche Appendix"

"Not applicable"

BACKGROUND OF THE INVENTION

1.) Field of the Invention

The present invention relates to a power assisted drum pedal for the specific use of improved playing performance on the drum set.

2.) Description of the Related Art

The U.S. Pat. No. 5,458,038 to Kurosaki discloses a prior art manual foot drum pedal for the playing performance on the bass drum of a drum set. This design presents, however, a drawback requiring the manual use of a spring having weighty resistive action, applied against the player's effort to play the pedal. Addtionally, prior art patents are for drum pedals played manually and present the same drawback to player performance.

A foot pedal as used for the bass drum of a drum set. The fundamental purpose of the foot pedal is to improve manual stability, during a performance on the drums. Although bass drum pedals have been used for decades to play the drums, these pedals such as the one described in the Kurosaki prior art patent have been played manually. Manual operation has always been used with a spring to recoil the pedal to the start or up position after the pedal was played down to the stop or end position by the player. Therefore, the ability to play the pedal has always been controlled by the resistive spring action and the associated moving parts of the pedal.

a) Music stores commonly supply consumers with a range of low to high quality drum pedals using the basic design of the Kurosaki patent. Depending on the quality of the drum pedal, a low quality pedal produces stiff feel of action and a high quality pedal offers improved feel of action to the player's effort.

b) The prior art design of the bass drum pedal requires manual movement, applying the player's effort on the pedal. With varied levels of the player's effort varied sound levels and effects can be played on the bass drum. The quality and effect of the drum sound can only be produced from the player's effort.

c) Thus, if an excellent player wanted excellent sound on the bass drum, player effort is wasted to play the pedal down to the end position against the resistance of a recoiling mechanical spring. Additionally, wasted effort to play/push the spring down could otherwise be used to create excellent sound on the drum and is wasted in the mechanical spring.

d) Manual bass drum pedals are of primitive design, using a spring with player effort applied to move the pedal down to play the bass drum. The mechanical spring inhibits player creativity on the drum pedal. These pedals have a weighty, resistive feel when played. The basic design of the prior art bass drum pedal prevent continuous smooth non-resistive action when played. Thereby, inhibiting the player's effort to perform on the bass drum.

e) Regardless of quality manual bass drum pedals always present a weighty resistive feel of action to the player's effort. The feel of action is always sluggish and tiring to the player, during a performance on the drums.

f) The sensistivity of operation is rigid. Using the best spring and associates moving parts, manual bass drum pedals still present the player with a friction like feel of action. Friction like feel of action inhibits the player's perfomance on the bass drum.

g) High levels of player effort must be applied to manual bass drum pedal designs. Bass drum pedals with low quality are especially difficult to play down and play the bass drum against the resistance of a mechanical spring. Although high quality pedals can have some smooth action, playing the pedal down to play the bass drum requires the same player effort equal to a low quality pedal.

BRIEF SUMMARY OF THE INVENTION

Accordingly, besides the objects and advantages of the bass drum pedal in the above patent several objects and advantages of the present invention are:

(a) to provide power assisted action to the player's effort, providing continuous flexible assistance, during a playing performance on the drums;

(b) to provide effortless feel of action to the player's effort, allowing the player full use of effort on the drums;

(c) to provide effortless feel of action to the player's effort, enabling the player to apply full effort and creativity to new and sophisticated sound on the drums;

(d) to provide fluid like feel of action to the player's effort, offering the player continuous control of sound effects on the bass drum without the resistance of mechanical spring;

(e) to eliminate weighty resistive feel of action to the player's effort and to eliminate tiring the player during a performance on the drums;

(f) to provide high sensistivity and speed eliminating friction like feel of action to the player's eflort;

(g) to eliminate high levels of player effort with little results to the player's performance on the drums.

Further objects and advantages are to provide a power assisted bass drum pedal that is compact light weight and portable. A pedal powered by AC line voltage using an AC/DC adapter or equivalent battery voltage.

Still further objects and advantages will become apparent to the player from use of the pedal and consideration of the ensuing description and drawing for same.

BRIEF DESRCIPTION OF THE SEVERAL VIEWS OF THE DRAWINGS

The present invention will be more fully understood, by referencing the attached drawing. Wherein, the present invention is presented with three (3) figures of view and thc following list of reference numbered numerals for same.

FIG. 1. Is an elevation view of the mounted motor mechanism with the pedal and rotating belts shown in the up or start position. Section 1A shows the rotating belts in the down or end position.

FIG. 2. Is an elevation view of a prior art drum pedal with a wheel mounted to the pedal and the enclosure for the motor mechanism.

FIG. 3. Is a plan view of FIGS. 1 and 2 combined, comprising the entire invention with the enclosure removed.

DETAILED DESCRIPTION OF THE INVENTION

1.) A desrciption of the preferred embodiment of the present invention is presented in FIGS. 1, 2 and 3.

Figure 1:
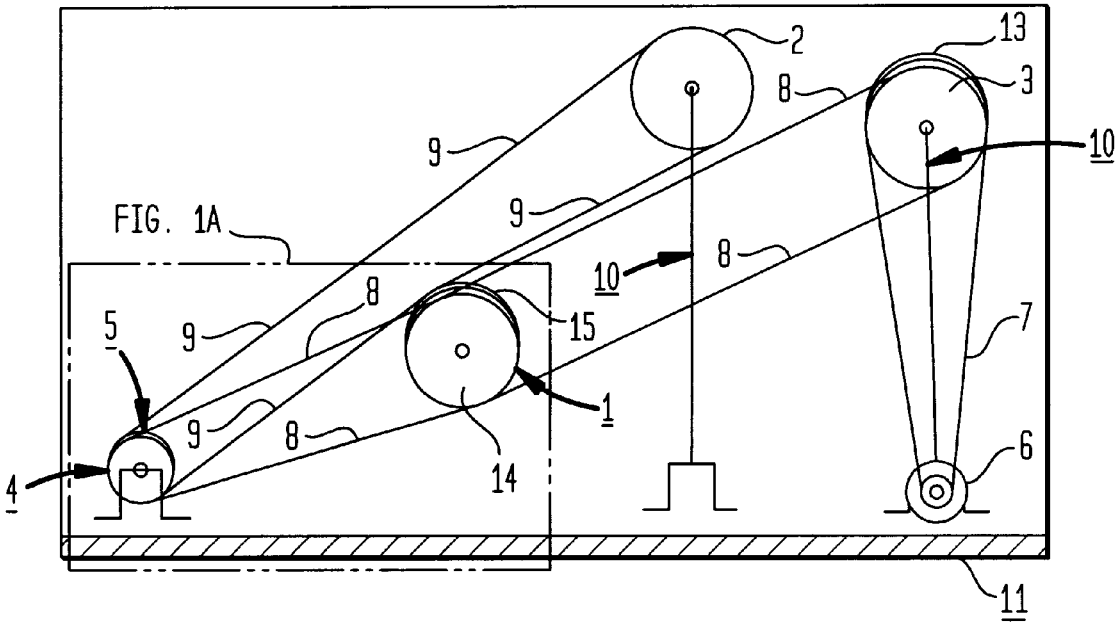
Figure 1A:
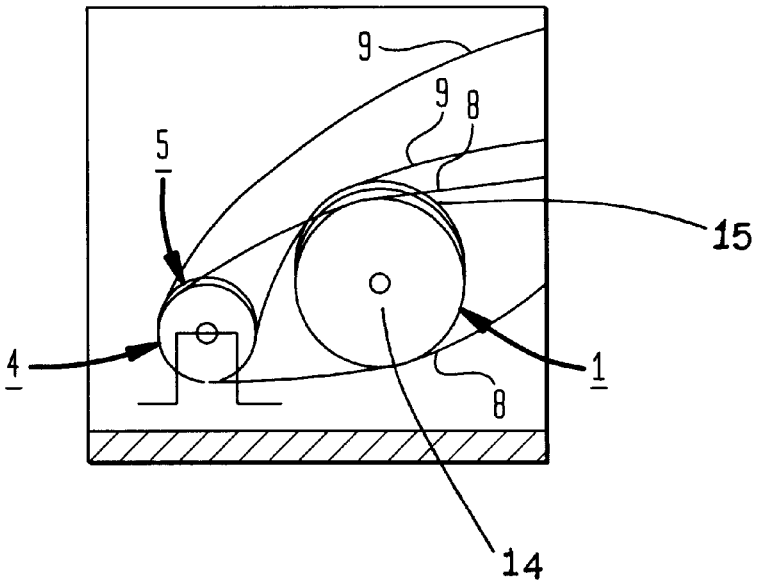

FIG. 1: Illustrates an elevation view of the motor mechanism mounted within enclosure 11. The view further shows the wheels and belts around the wheels that comprise the motor mechanism. Three (3) rotational belt assemblies comprise the drive assembly, driven by motor 6. The belts are shown with pedal 12 (not shown) in the up or start position and in section 1A with pedal 12 in the down or end position. Each numbered belt assembly, Belt 7, belt 8, belt 9, encompass respective wheels shown in this figure. Belt 7 rotates around the wheel of motor 6 and wheel 13. Belt 8 rotates around wheel 3, wheel 1 and wheel 4. Belt 9 rotates around wheel 2, along wheel 1 and around wheel 5. Motor 6 is for rotational energy to drive belt 7 around wheel 13. Wheel 13 is connected to wheel 3. Wheel 3 rotates belt 8 along the base tangent point of wheel 1 and around wheel 4. Wheel 1 tows belt 9 around wheel 2 and wheel 5. Rotational energy from motor 6 is distributed to wheel 1 from wheel 3 connected to wheel 13. Wheel 13 is rotated from motor 6 with belt 7. Wheel 2, wheel 13 and wheel 3 are mounted on brackets 10. Motor 6. wheel 5 and wheel 4 are shown with self-mount brackets.

Figure 2:
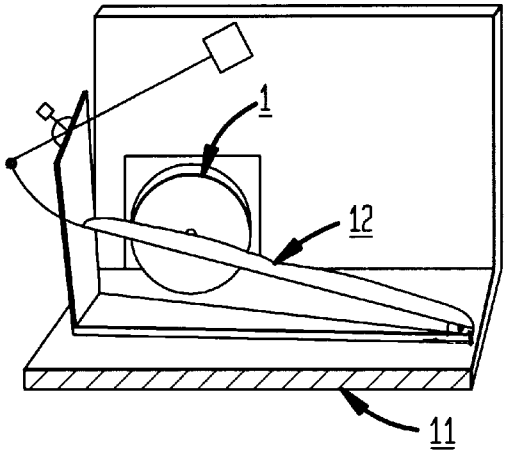

FIG. 2: Illustrates an elevation view of the enclosure of 11, wheel 1 and pedal 12. Wherein, a cut-out view of the wall of enclosure 11 shows wheel 1 mounted to pedal 12. During play, wheel 1 moves down to the end postion and up to the start postion with the foot action of the player of pedal 12.

Figure 3:
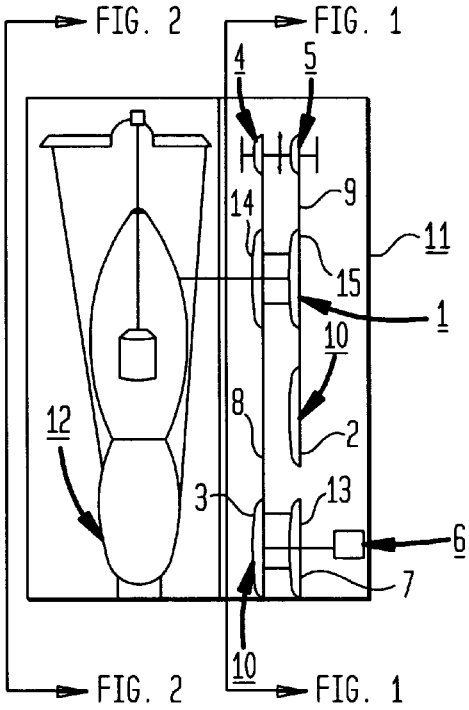

FIG. 3: Illustrates a plan view of the axle of wheel 1 mounted to pedal 12 and enclosure 11 removed showing the pedal mount and motor mechanism assembly. The view further shows wheel 3 connected to 13 mounted on bracket 10.

Wheel 13 thereby rotates wheel 3 and belt 8 from belt 7 of motor 6. Wheel 1 is shown with the connection of wheel 14 to wheel 15. Wheel 1 comprises wheel 14 and wheel 15, the connection allows wheel 14 and wheel 15 to rotate together acting as one wheel. Wheel 1 is shown rotated with belt 8 at the base tangent point of wheel 1 (wheel 14, of wheel 1, shown) and towing belt 9 along the crest tangent point of wheel 1 (wheel 15 of wheel 1, shown). The pedal is shown connected to the motor mechanism by wheel 1 rotated with belt 8. Thereby providing rotational energy to wheel 1 from motor 6. Motor 6 is shown with belt 7 to rotate wheel 13. Wheel 13 and wheel 3 are shown connected together. Wheels 13 and wheel 3 connect together and have separate functions. Wheel 13 is rotated by motor 6 using belt 7. Wheel 3 provides rotational energy to belt 8 connected to wheel 3. Belt 9 is shown towed at the crest tangent point of wheel 15. Wheel 15 tows belt 9 around wheel 2 and wheel 5. Wheel 2 is mounted on bracket 10. The bracket assembly for wheel 4 and wheel 5 is one (1) bracket and axle assembly. Wheels 4 and wheel 5 spin separately, with belts 8 and belt 9 respectively.

2.) Operation of FIGS. 1, 2 and 3.

The operation/play of pedal 12 begins in the start or up position. During play wheel 1 (comprising wheel 14, wheel 15 ) moves down to the end position and up to the start position with pedal 12. Wheel 1 is rotated by belt 8 at the sag tangent point of wheel 1. The crest tangent point of wheel 1 (wheel 14 of wheel 1) is a guide for belt 8 around wheel 1 and does not effect operation of the pedal. The towing force of belt 9 along the crest tangent point of wheel 1 (wheel 15 of wheel 1) creates a resistive rotational drag effect across the diameter of wheel 1 or lever action effect across the diameter of wheel 1 (imaginary lever).

The interaction or differential force occuring between belt 8 and belt 9 create a lever action effect to assist operation of pedal 12. Lever action effect assists the player's effort to play the pedal. The effect varies in force from minimum to maximum action and maintains equilibrium action effect to the manual effort applied by the player. As pedal 12 is played it first descends and lever action effect across the diameter of wheel 1 and between belt 8 and belt 9 is generated gradually from minimum at the start or up position, to maximum force in the down or end position. Lever action effect increases when pedal 12 moves forward and downward moving wheel 1 further into belt 9, increasing rotational drag on wheel 1. With pedal 12 down to end or stop position, lever action effect is greatest and applies full assistance to pedal 12. The reverse action occurs when 12 rises up or to the start position and lever action effect is proportionally decreased from maximum to minimum force effect.

The pedal plays down to end position and up to start position. Played down to end or stop position, recoil resistance of the spring in pedal 12 increases to maximum. Played up to the up or start position, recoil spring resistance decreases to minimum. When played down to the end (see belt postions FIG. 1, Section 1A) forward and downward movement of pedal 12 moves wheel 1 into belt 9 increasing tension on belt 9. When played up to start, (see belt positions FIG. 1) upward and backward movement of pedal 12 moving wheel 1 away from belt 9 decreases tension on belt 9. Played down to end position, tension on belt 9 increases to maximum and power assisted player action increases. Played up, power assisted action decreases to minimum when tension on belt 9 is decreased reducing power assisted action to the player's effort on the pedal.

The amount of lever action or equilibrium assistance to the player's effort in any stationary pedal position remains proportional and constant to the position of play. When pedal 12 is held in any stationary position by the player, lever action effect remains porportional and constant in force to the stationary position of play held by the player. Therefore providing continuous assistance to the player's effort in the stationary position. Lever action effect is decreased and returns to minimum when pedal 12 returns to the start or up position.

3.) Summary, Ramifications and Scope.

The fundamental objective of the invention is to provide power assisted action to the player's effort on a bass drum pedal of a drum set. In which a motor mechanism rotates a belt, driving a wheel mounted to a prior art manual drum pedal. The effect of the wheel is to generate power assisted action to the player's effort on the drum pedal during a playing performance on the drum set.

Accordingly the reader will see that a power assisted drum pedal can easily be used to replace a prior art manual drum pedal and add great advantages to the player's performance on the drums.

In addition, the motor mechanism of this invention can be further adapted for use on the hi-hat cymbals assembly and provide power assistance to the player's effort on the hi-hat. Further, in cases where double bass drums is desirous the motor mechanism can be adapted for use with two (2) bass drum pedals to play (2) pedal beaters, on one (1) drum or two (2) drums.

- it permits more precision use of the hi-hat cymbals and bass drums;
- it permits the player to use minimum effort playing the hi-hats and bass drums;

it allows for fast, clean, precise, action especially needed for double bass drums and hi-hats;

it moreover eliminates high levels of manual player effort, possible only with powered assistance, allowing more use of the player's effort on the drum set.

Although the description above contains many specificities, these should not be construed as limiting the scope of the invention but merely providing illustrations of some of the presently preferred embodiments of this invention. For example, the motor mechanism shall have other shapes ( square, round, triangular, trapezoidal, oval, etc.,) especially if designed for hi-hat and/or double bass drum. The motor mechanism can be used with a bracketed assembly for use with double bass drums and/or hi-hats. The motor mechanism can have various types of drives, other than the belts shown in this patent. The drives or linkages can be chains, gears, or an equivalent lever action mechanism, to effect and assist pedal operation. Thus, the scope of the invention should be determined by the appended claims and their legal equivalents, rather than by the example given.

I claim:

1. A power assisted foot operated bass drum pedal, comprising: a motor mechanism assembly connected to a manual foot pedal for assisting the movement of said pedal by a player; said assembly comprises a plurality of wheels connected by a plurality of rotational belts; and means to produce a lever action effect to said pedal by one of said plurality of wheels rotated by said motor mechanism assembly.

2. The bass drum pedal of claim 1 wherein said one wheel is mounted on said pedal for a lever action effect to assist operation of a bass drum pedal.

* * * * *